US007743506B2

(12) United States Patent
Szczepanowski et al.

(10) Patent No.: US 7,743,506 B2
(45) Date of Patent: Jun. 29, 2010

(54) HEATED SHAVING RAZORS

(75) Inventors: Andrew Szczepanowski, Walpole, MA (US); Robert A. Trotta, Pembroke, MA (US)

(73) Assignee: The Gillette Company, Boston, MA (US)

( * ) Notice: Subject to any disclaimer, the term of this patent is extended or adjusted under 35 U.S.C. 154(b) by 564 days.

(21) Appl. No.: 11/248,953

(22) Filed: Oct. 11, 2005

(65) Prior Publication Data

US 2007/0084058 A1 Apr. 19, 2007

(51) Int. Cl.

| | |
|---|---|
| ***B26B 19/00*** | (2006.01) |
| ***B26B 19/44*** | (2006.01) |
| ***B26B 21/00*** | (2006.01) |
| ***F27D 11/00*** | (2006.01) |
| ***H05B 3/06*** | (2006.01) |

(52) U.S. Cl. ..... 30/34.05; 30/32; 30/41.5; 219/385; 219/386; 219/520

(58) Field of Classification Search ..... 30/32, 30/41.5, 51, 526, 536, 541, 34.05, 45; 219/385, 219/386, 200, 201, 520–522

See application file for complete search history.

(56) References Cited

U.S. PATENT DOCUMENTS

| | | | | |
|---|---|---|---|---|
| 1,505,578 | A | 8/1924 | Barra | |
| 1,552,026 | A * | 9/1925 | Barra | 30/34.05 |
| 1,821,574 | A * | 9/1931 | Peters | 30/41.8 |
| 2,018,147 | A | 10/1935 | Pirwitz | |
| 2,063,808 | A | 12/1936 | Henderson et al. | |
| 2,164,581 | A | 7/1939 | Ewald | |
| 2,225,257 | A * | 12/1940 | Conill | 30/34.05 |
| 2,231,219 | A | 2/1941 | Peterson | |
| 2,324,148 | A | 7/1943 | Gravin | |
| 2,414,482 | A * | 1/1947 | Kelso | 219/542 |
| 2,622,319 | A | 12/1952 | Hunt | |
| 2,714,651 | A * | 8/1955 | Wotton | 219/239 |
| 3,364,568 | A | 1/1968 | Lowy | |
| 3,611,568 | A | 10/1971 | Alexander et al | |
| 3,648,368 | A | 3/1972 | Douglass et al. | 30/60.5 |
| 3,896,364 | A | 7/1975 | Reister | |
| 3,934,115 | A | 1/1976 | Peterson | |
| 4,077,119 | A | 3/1978 | Sellera | |

(Continued)

FOREIGN PATENT DOCUMENTS

| | | |
|---|---|---|
| DE | 575 523 | 4/1933 |

(Continued)

OTHER PUBLICATIONS

PCT International Search Report dated Jun. 19, 2007, 20 pages.

*Primary Examiner*—Ghassem Alie
*Assistant Examiner*—Bharat C Patel
(74) *Attorney, Agent, or Firm*—Joanne N. Pappas; Kevin C. Johnson; Steven W. Miller

(57) ABSTRACT

Razors and systems for wet shaving are provided. The razors include a heating element and a heating material that may be heated by the heating element. Some systems include a holder for the razor, comprising contacts positioned to engage electrical contacts of the razor and deliver power from a power source to the heating element.

9 Claims, 4 Drawing Sheets

U.S. PATENT DOCUMENTS

| | | | | |
|---|---|---|---|---|
| 4,253,013 | A | 2/1981 | Mabuchi | 219/521 |
| 4,377,034 | A * | 3/1983 | Druash et al. | 30/41 |
| 4,598,192 | A * | 7/1986 | Garrett | 219/201 |
| 4,716,652 | A * | 1/1988 | Cataudella | 30/41 |
| 4,809,432 | A * | 3/1989 | Schauble | 30/41 |
| 4,864,735 | A | 9/1989 | Chung | |
| 4,918,818 | A | 4/1990 | Hsieh | |
| 5,010,905 | A | 4/1991 | Snyder et al. | |
| 5,046,249 | A | 9/1991 | Kawara et al. | 30/45 |
| 5,098,414 | A | 3/1992 | Walker | |
| 5,113,585 | A | 5/1992 | Rogers et al. | 30/41 |
| 5,121,541 | A | 6/1992 | Patrakis | |
| 5,191,712 | A | 3/1993 | Crook et al. | 30/34.2 |
| 5,299,354 | A | 4/1994 | Metcalf et al. | 30/45 |
| 5,394,777 | A * | 3/1995 | Kozikowski | 83/15 |
| 5,402,573 | A * | 4/1995 | Laniado | 30/41 |
| 5,454,164 | A | 10/1995 | Yin et al. | 30/41 |
| 5,653,025 | A * | 8/1997 | Cheng et al. | 30/41 |
| 5,782,346 | A | 7/1998 | Gray et al. | |
| 5,794,342 | A | 8/1998 | Davey | 30/45 |
| 6,158,125 | A | 12/2000 | Dolev | 30/43.6 |
| 6,301,792 | B1 | 10/2001 | Speer | |
| 6,421,918 | B1 | 7/2002 | Dato et al. | 30/45 |
| 6,430,813 | B2 | 8/2002 | Muraguchi et al. | |
| 6,481,104 | B1 | 11/2002 | Parker et al. | 30/45 |
| 6,574,866 | B2 | 6/2003 | Pragt et al. | 30/34.2 |
| 6,763,590 | B2 | 7/2004 | Guimont et al. | |
| 6,836,966 | B2 * | 1/2005 | Patrick | 30/34.05 |
| 6,868,610 | B2 * | 3/2005 | Brandt et al. | 30/41 |
| 6,946,624 | B1 * | 9/2005 | Tomassetti | 219/386 |
| 2001/0003869 | A1 * | 6/2001 | Rocha | 30/41 |
| 2001/0023538 | A1 | 9/2001 | Muraguchi et al. | |
| 2002/0096512 | A1 | 7/2002 | Abbott et al. | 219/543 |
| 2002/0189102 | A1 | 12/2002 | Orloff | 30/41.7 |
| 2003/0046816 | A1 | 3/2003 | Kanzer | 30/32 |
| 2003/0101589 | A1 | 6/2003 | Barish | |
| 2003/0154832 | A1 * | 8/2003 | Guimont et al. | 83/13 |
| 2003/0155887 | A1 | 8/2003 | Bourikov et al. | |
| 2003/0226258 | A1 | 12/2003 | Patrick | 30/34.05 |
| 2003/0231001 | A1 | 12/2003 | Bruning | |
| 2004/0045948 | A1 | 3/2004 | Shalev et al. | 219/223 |
| 2004/0074097 | A1 | 4/2004 | Guimont et al. | |
| 2006/0070242 | A1 * | 4/2006 | Szczepanowski et al. | 30/140 |

FOREIGN PATENT DOCUMENTS

| | | |
|---|---|---|
| DE | 2 801 845 | 7/1979 |
| FR | 520 234 | 6/1921 |
| FR | 749 861 | 8/1933 |
| FR | 840 502 | 4/1939 |
| FR | 985 030 | 7/1951 |
| FR | 2 716 402 | 5/1995 |
| GB | 541723 | 12/1941 |
| GB | 1075139 | 7/1967 |
| WO | WO 92/13684 | 8/1992 |
| WO | WO 94/04106 | 3/1994 |
| WO | WO 97/08804 | 3/1997 |
| WO | WO 2005/120782 | 12/2005 |

* cited by examiner

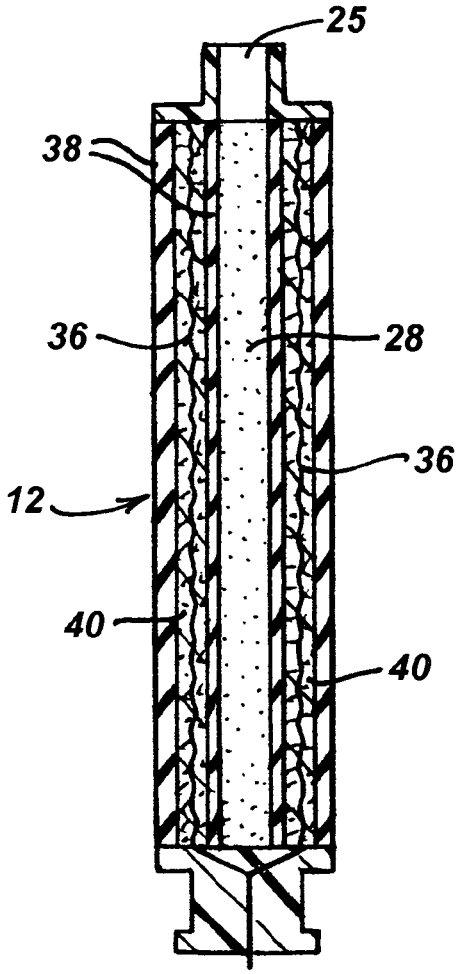
FIG. 1A
FIG. 1B
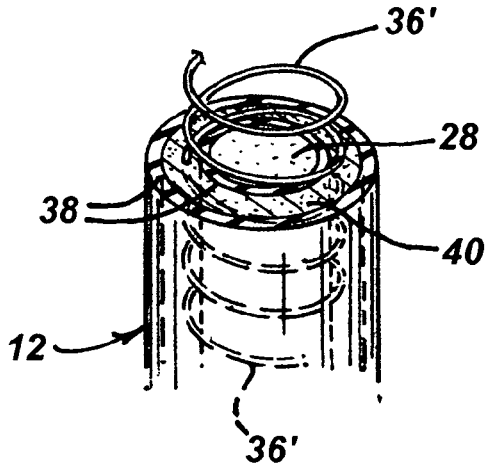

HEATED SHAVING RAZORS

TECHNICAL FIELD

This invention relates to shaving razors and razor cartridges, and more particularly to razors for wet shaving.

BACKGROUND

Users of wet-shave razors generally appreciate a feeling of warmth against their skin during shaving. The warmth feels good, resulting in a more comfortable shave.

Various attempts have been made to provide a warm feeling during shaving. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery.

In some cases, a portion of the razor is heated using a phase change material. Such razors are described in U.S. Pat. No. 6,868,610, the disclosure of which is incorporated herein by reference.

SUMMARY

There are several aspects of the invention which features razors that include a heating element within the handle to which power is supplied from a source that is external to the handle. Heat is delivered from the handle to the cartridge, for example by a fluid which flows from the handle to the cartridge. In some embodiments, fluid is dispensed from the cartridge.

In one aspect, the invention features a razor for wet shaving including a handle including a hollow body having an outer surface, electrical contacts disposed on the outer surface, a heating element within the handle, in electrical communication with the contacts, a heating material, disposed within the hollow body so as to be heated by the heating element, a blade unit, extending from the handle, carrying a plurality of blades having elongated cutting edges, and a fluid passageway through which the heating material can be delivered from the blade unit during shaving.

Some embodiments include one or more of the following features. The razor may further include a phase change material disposed within the handle. The heating material may be a solid capable of liquefying when heated. The heating material may include a soap, a shaving preparation or a shaving aid. The blade unit may include an aperture through which the material is dispensed, and may in some cases include a valve configured to control flow through the aperture. The hollow body may be thermally insulative. The razor may include means for moving the heating material from the handle into the blade unit. The razor may include means for indicating to a user that the heating material has reached a predetermined temperature.

In another aspect, the invention features a system for wet shaving including: (a) a razor, including (i) a handle including a hollow body having an outer surface, (ii) electrical contacts disposed on the outer surface, (iii) a heating element within the handle, extending between the contacts, and (iv) a blade unit, extending from the handle, carrying a plurality of blades having elongated cutting edges; and (b) a holder for the razor, comprising contacts positioned to engage the contacts of the razor and deliver power from a power source to the heating element.

Some embodiments may include one or more of the following features. The power source may include a battery disposed within the holder, and/or an external power source. The system may include means for indicating to a user that the heating material has reached a predetermined temperature, e.g., a mechanism configured to cause the razor to pop up out of the holder or a thermochromic indicator. The razor may include a heating material, disposed within the hollow body, selected from the group consisting of liquids, foams, gels, and solid or semi-solid materials that liquefy when heated. The heating material may be disposed in a replaceable cartridge within the razor handle.

In yet a further aspect, the invention features a holder for a wet shaving razor including a body configured to receive the razor, and electrical contacts positioned on the body to engage electrical contacts of the razor and deliver power from a power source to the razor.

The invention also features razors configured to allow the handle to be heated using a resistive element and phase change material.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 1A is an enlarged axial cross-sectional view of a portion of the handle of the razor shown in FIG. 1, showing components of the handle housing that are not shown in FIG. 1, including heating elements that extend along the length of the handle. The plunger/spring assembly shown in FIG. 1 is omitted in this view. FIG. 1B is an enlarged radial cross-sectional view of an alternative embodiment of the handle in which the heating element is helically wound.

Like reference symbols in the various drawings indicate like elements.

DETAILED DESCRIPTION

Figure 1:
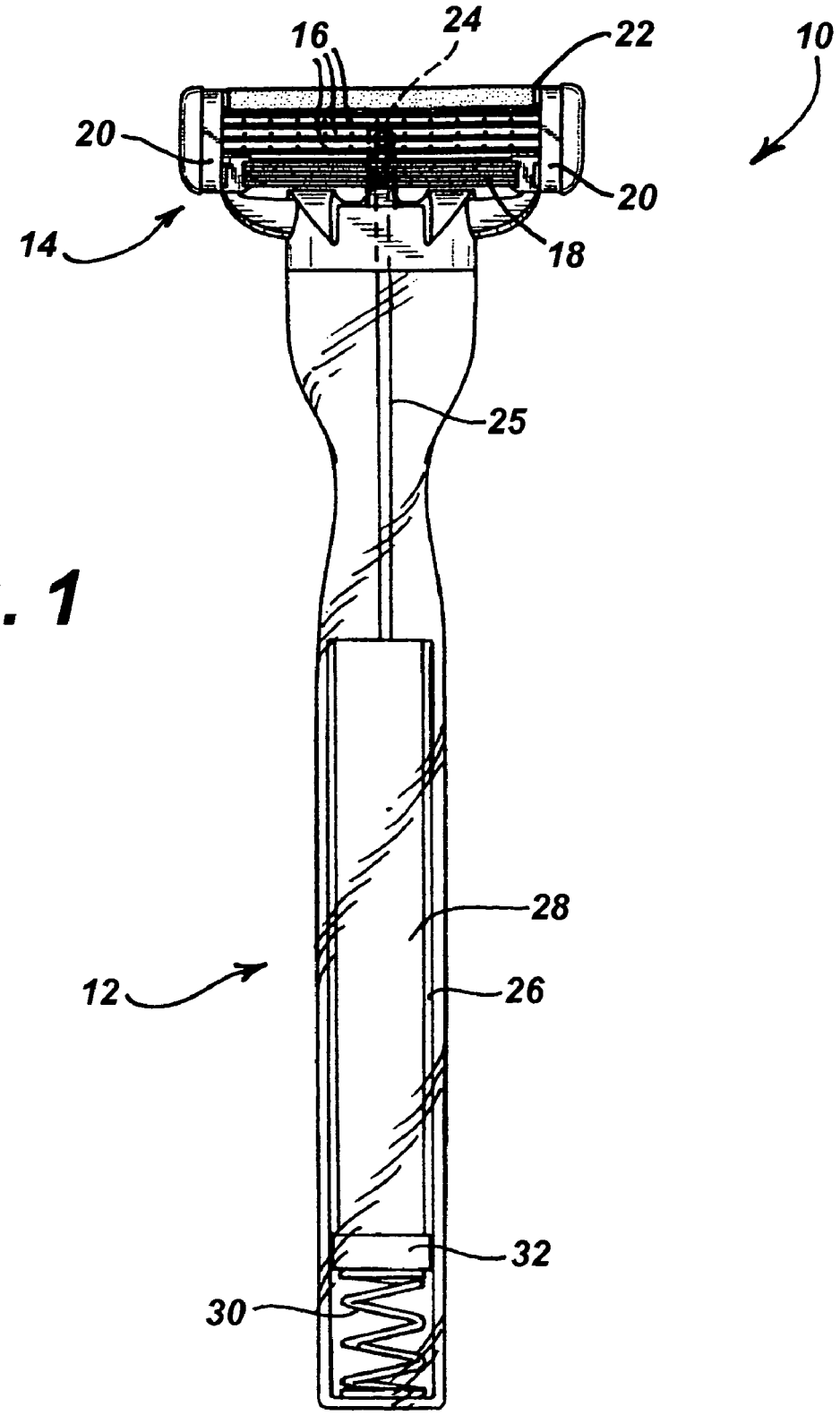
FIG. 1 is a diagrammatic front view of a razor, with the handle housing shown as transparent.

Referring to FIG. 1, a razor 10 includes a handle 12 and a blade unit 14 mounted on the handle. The blade unit may be a replaceable cartridge, detachably mounted on the handle, or may extend integrally from the handle if the razor is disposable.

The blade unit includes a plurality of blades 16, a guard 18, a pair of clips 20 to secure the blades, and a cap 22, as is well known. The blade unit also includes an orifice 24, through which a component may be dispensed. The orifice 24 is in fluid communication with the handle 12 via a conduit 25.

The handle 12 defines a chamber 26, which contains a cylindrical plug 28 of a meltable material, e.g., a soap. The material is melted by heat supplied to the handle from an external power source, as will be discussed below. The cylindrical plug 28 is biased against the top of chamber 26 by a spring 30 that presses against a plunger 32 on which the plug rests, forcing the warm, melted material out through the conduit 25 and orifice 24. In some implementations, the razor is configured to be disposable once the material of plug 28 is exhausted. In other implementations, the razor is configured to be recharged with more material, for example by replacing plug 28, e.g., by removing the spring and a cap (not shown) at the end of the handle and inserting a new plug. The holder or organizer for the razor may be configured to hold a supply of replacement cartridges and/or plugs.

Figure 2:
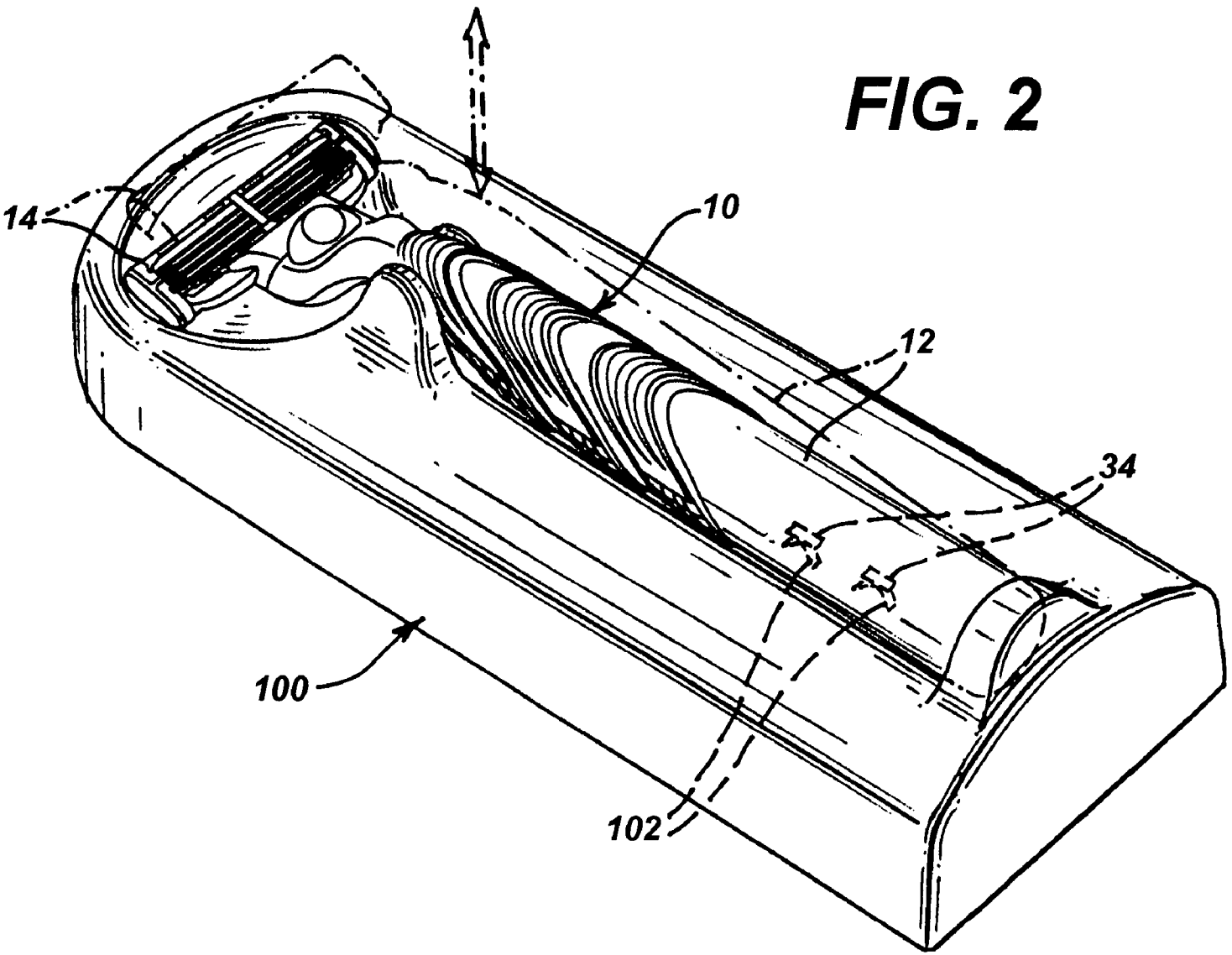
FIG. 2 is a diagrammatic perspective view of a holder for the razor of FIG. 1, capable of delivering power to the razor to heat the handle.

The handle also includes contacts (not shown) positioned to engage corresponding contacts on a holder 100 (shown in FIG. 2 and discussed below) to allow current to be delivered to the handle from an external source. The contacts may be positioned anywhere along the handle, and may be adjacent to each other or spaced from each other, e.g., at opposite ends of the handle. The external source may be, for example, batteries disposed within the holder (not shown) or AC power delivered to the holder through a power cord (not shown).

Referring now to FIGS. 1A and 1B, the handle includes a heating element, e.g., a resistive element, that receives current from the power source and, due to its relatively high resistance, heats the handle. In the embodiment shown in FIG. 1A, the heating elements 36 extend along the length of the handle within the thermally insulative housing 38 of the handle. In an alternate embodiment, shown in FIG. 1B, the heating element 36' is helically wound around the plug 28. In both embodiments, the heating element is embedded in a phase change material 40 within a tubular chamber defined by the housing 38. Phase change materials store latent heat when melted, and release it during recrystallization. The phase change material in the handle is a solid at room temperature, and can be easily melted, "thermally charging" the razor. (The phase change material is enclosed in the tubular chamber and thus will not flow out when melted.) As the melted phase change material recrystallizes it will release heat in a controlled manner, at a specific temperature (the melting point of the phase change material) melting the material of plug 28 in a controlled manner. Generally, the temperature of the phase change material will not exceed the melting temperature of the material for any significant period of time (i.e., within a few seconds), even if the heating element reaches a higher temperature. Thus the temperature of the melted material of plug 28 will not exceed the melting point of the phase change material until all of the phase change material has melted. Therefore, it is unlikely that the dispensed material will become uncomfortably hot. Moreover, the phase change material distributes the heat provided by the heating element uniformly around the plug 28, and holds the heat for a period of time after current ceases to be delivered to the heating element.

The phase change material may include a paraffin, a low melting salt, a low melting salt containing water of crystallization, a low melting eutectic mixture of organic or inorganic compounds, a low melting metal or alloy, a micro-encapsulated phase change material, or blends of the above materials. The phase change material may include an alkyl carboxylic acid. The phase change material may be selected from the group consisting of undecanoic acid, decanoic acid, nonadecane, eicosane, and tridecanoic acid. In some implementations, the razor includes a plurality of phase change materials, e.g., phase change materials having different recrystallization/nucleation rates. Razors including phase change materials are described in U.S. Pat. No. 6,868,610, the disclosure of which is incorporated herein by reference.

When the razor described above is placed in the holder 100, contacts 34 of the razor engage contacts 102 of the holder. Current is then delivered from the power source to the heating element 36, heating the phase change material and melting a portion of the plug 28. It is generally preferred that flow to the orifice 24 be closed off during heating and prior to shaving, so that the material of plug 28 does not escape through the orifice onto the holder. For example, if the razor includes a removable cartridge that includes a blade unit pivotally attached to a connecting part, flow may be inhibited by the flow path including a pair of holes in the blade unit and connecting part that are misaligned when the razor is in the holder 100 but align with each other when the razor is in use. Flow may be inhibited by any other desired means, e.g., the razor may include a valve that is constructed to be closed when the razor is in place on the holder and to open when the razor is in use, or the holder may include a plug or other means of sealing the orifice 24.

While the razor is being thermally charged, the user can prepare for shaving by cleansing and then applying a shave preparation. When the razor has been sufficiently thermally charged, this will be indicated to the user. For example, the razor may "pop-up" out of the holder. This may be accomplished by any suitable means, e.g., an electrical solenoid or a biased spring with a release lever, configured so that when the razor is ready the electronics signal the lever to open and the bias spring acts on the handle. Alternatively, or in addition, a light may illuminate or an audible indication may be provided, such as a buzzing or a chime. Any other desired indicator may be used. If desired, the indicator may be timed to go off just before the material is sufficiently softened so that it will exude out of orifice 24, obviating the need for a valve or seal to inhibit flow of material onto the holder.

In some implementations, the indicator may be an element that changes color when the razor reaches the desired temperature. In this case, the indicator may include a thermochromic material, e.g., a strip positioned on the razor, or an alphanumeric indicia that appears when the razor is thermally charged.

Figure 3:
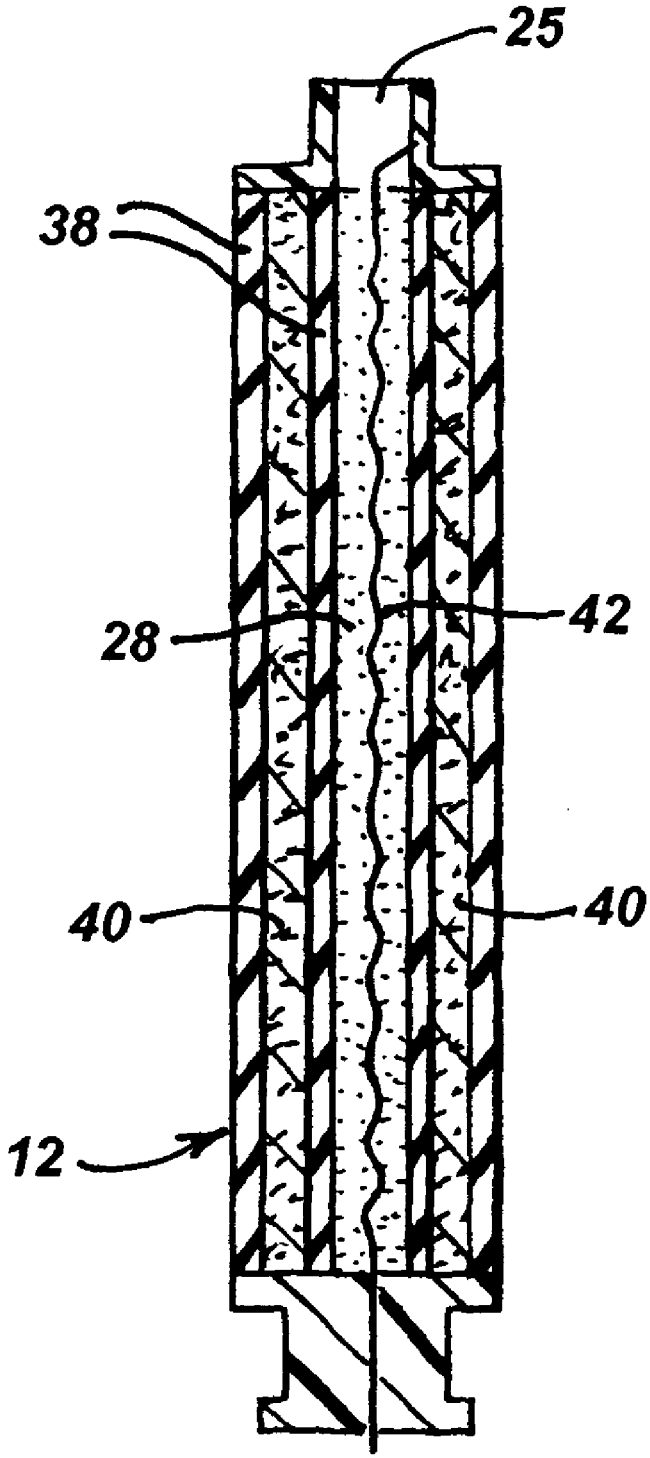
FIG. 3 is an enlarged axial cross-sectional view of an alternative handle design for the razor of FIG. 1.

In an alternative embodiment, shown in FIG. 3, the handle includes a single resistive element 42 that extends through the material to be melted. Positioning the resistive element in the material to be melted allows the material to be melted more quickly. Part of the heat would be transmitted to the surrounding phase change material, which would then melt and act as an insulating blanket due to the latent heat retained by the phase change material. The resistive element and the material to be melted may be supplied as an integral, replaceable unit, e.g., a plug of material as described above.

A number of embodiments of the invention have been described. Nevertheless, it will be understood that various modifications may be made without departing from the spirit and scope of the invention.

For example, in some cases the razor is configured so that nothing is dispensed from the cartridge. In these implementations, the handle is heated to provide a warm, comfortable feeling to the user's hand during shaving. The cartridge is generally not heated. In such razors, the handle is generally configured as discussed above, except that conduit 25 is omitted and instead the handle is a sealed unit. The meltable material in these implementations may be any material having the desired thermal characteristics, and need not be skin-friendly.

In implementations in which a material is dispensed during shaving, the material need not be solid prior to heating. If desired, the material may be a lotion, gel, or other liquid or semi-solid. In such cases, the orifice through which the material is dispensed may include a valve, e.g., a one-way valve such as a slit valve. In this case, the user may control dispensing, for example by actuating a spring-biased plunger that will not apply pressure to the material to be dispensed until actuated by the user. For example, the user may press a button on the handle, causing pressure to be applied to the material within the razor, forcing open the one-way valve sealing the orifice 24. If desired, the razor may be constructed to dispense more than one material, e.g., through co-axial passageways, in which case a suitable multi-lumen valve is described in as described in U.S. Ser. No. 11/114,987, titled "Valves for Personal Care Devices" and filed on Apr. 26, 2005, the entire disclosure of which is incorporated herein by reference.

While a simple spring and plunger mechanism has been shown herein and described above, other means can be used to apply pressure to the heated material within the razor and force it out of the orifice 24. For example, by using a squeeze bulb or by turning a knob attached to a plunger (a technique used to dispense stick deodorants).

Accordingly, other embodiments are within the scope of the following claims.

What is claimed is:

1. A razor for wet shaving comprising:

a handle including a hollow body having an outer surface, electrical contacts disposed on the outer surface, a blade unit, extending from the handle, carrying a plurality of blades having elongated cutting edges, at least one heating element within the handle, in electrical communication with the contacts, at least one phase change material disposed within the hollow body, a heating material, disposed within the hollow body so as to be heated to fluid by the heating element or the phase change material, wherein the at least one phase change material, the at least one heating element and the heating material are adjacent to one another in the handle, and a fluid passageway through which the heating material can be delivered from the blade unit during shaving.

2. The razor of claim 1 wherein the heating material comprises a soap.

3. The razor of claim 1 wherein the heating material comprises a shaving preparation or shaving aid.

4. The razor of claim 1 wherein the blade unit includes an aperture through which the material is dispensed.

5. The razor of claim 4 wherein the blade unit further includes a valve configured to control flow through the aperture.

6. The razor of claim 1 wherein the hollow body is thermally insulative.

7. The razor of claim 1 further comprising a means for moving the heating material from the handle into the blade unit.

8. The razor of claim 1 further including a means for indicating to a user that the heating material has reached a predetermined temperature.

9. The razor of claim 1 wherein the phase change material holds the heat for a period of time after current ceases to be delivered to the heating element.

* * * * *